United States Patent [19]

Sharp et al.

[11] Patent Number: 5,041,019

[45] Date of Patent: Aug. 20, 1991

[54] TRANSITION JOINT FOR MICROWAVE PACKAGE

[75] Inventors: William F. Sharp, Louisville; Prem R. Hingorany, Broomfield; Howard W. Mansell, Englewood, all of Colo.

[73] Assignee: Explosive Fabricators, Inc., Louisville, Colo.

[21] Appl. No.: 607,563

[22] Filed: Nov. 1, 1990

[51] Int. Cl.[5] ..... H01B 17/26

[52] U.S. Cl. ..... 439/559; 174/152 GM; 439/935

[58] Field of Search ..... 439/559, 566, 935; 174/152 GM; 228/179

[56] References Cited

U.S. PATENT DOCUMENTS

| | | | |
|---|---|---|---|
| 4,213,004 | 7/1980 | Acker et al. | 174/152 GM |
| 4,486,726 | 12/1984 | Schafer et al. | 333/260 |
| 4,487,999 | 12/1984 | Baird et al. | 174/52 |
| 4,642,578 | 2/1987 | Bennett | 331/100 |
| 4,690,480 | 9/1987 | Snow et al. | 439/935 |
| 4,799,036 | 1/1989 | Owens | 333/260 |
| 4,816,791 | 3/1989 | Carnahan et al. | 333/33 |
| 4,906,957 | 3/1990 | Wilson | 333/246 |

*Primary Examiner*—Gary F. Paumen

*Attorney, Agent, or Firm*—Fields, Lewis, Pittenger & Rost

[57] ABSTRACT

In accordance with this invention, a hermetically sealed transition joint for use with a microwave package which has a receptacle including a side wall made of a first weldable material with a feed-through opening therein. The transition joint includes a first layer of a first material sized to extend across the feed-through opening and weldable to the side wall to form a hermetic seal. A second layer of a second material is explosively bonded to the first layer and sized to match and be received within the feed-through opening. A connector opening extends through the first and second layers. A pin connector unit made of the second material and having electrical pins extending therethrough is sized to fit within the connector opening and is welded to the second layer to form a hermetic seal. The first layer may be aluminum or aluminum alloy and the second layer can be any one of Kovar, cold rolled steel, stainless steel or iron-nickel alloy. Conveniently, the welding is done by laser welding.

9 Claims, 1 Drawing Sheet

TRANSITION JOINT FOR MICROWAVE PACKAGE

TECHNICAL FIELD

This invention relates to the fabrication of a transition joint for microwave packages. In particular, this invention allows the hermetic attachment of standard feed-throughs and power connectors to standard aluminum microwave packages.

BACKGROUND ART

Microwave electronic packages are frequently produced from aluminum alloys due to low weight and good thermal dissipation. These packages are machined from thick aluminum or an aluminum alloy block. This block is relieved on one side to form a deep cavity within which an electronic circuit is placed. Small holes are formed in the package walls to accept feed-throughs and power connectors, respectively. A cover is placed over the cavity and attached by a suitable method. These packages are required to be hermetic from $10^{-5}$ to $10^{-8}$ helium cc/sec. maximum leak rate.

However, two of the major disadvantages of aluminum are high coefficient of thermal expansion and dewetting properties causing poor solderability. In order to be able to solder the aluminum, these microwave packages are typically electroplated with metals like nickel and/or gold. The feed-throughs and the power connectors which are fabricated from cold rolled steel, stainless steel and iron-nickel alloys are soldered into the holes and the windows along the side walls. There are a variety of solders used for this purpose by the industry.

The electronic signals are allowed to enter and exit the package via pins contained within the feed-throughs and power connectors. The feed-throughs contain a pin of desired metal surrounded by a bead of molten glass which is surrounded by a ring of cold rolled steel, stainless steel and/or iron-nickel alloy. The pin serves as an electrical connection to communicate with the electronic circuit inside the package. The glass provides electronic isolation between the pin and the package.

The reliability of the feed-through and the power connector attachment is typically very poor. Besides the difficulty of a good attachment during manufacture, these joints commonly fail upon thermal cycling. There are two recognized reasons. First, poor nickel and/or gold plating of the packages, feed-throughs and power connectors or excessive leaching of the plated metals during soldering. This results in exposure of dewetting aluminum surface which inhibits soldering. The second reason is mismatched expansion between the aluminum or aluminum alloy of the package and the feed-throughs and power connectors. The coefficient of thermal expansion of aluminum alloys is $22\times10^{6}$ in/deg.C/in. vs. that of cold rolled steel and stainless steel at $12\times10^{-6}$ and iron-nickel alloys at $7\times10^{-6}$. This mismatch in expansion during thermal cycling creates stresses which causes loss of the hermeticity and expensive rework and repeat of testing. In frequent situations upon multiple recurrence, the package becomes useless and is discarded.

In a recent development, some package manufacturers have attempted to develop new glasses that are compatible to aluminum. This, if successful, may allow direct glass sealing of pins into aluminum side walls, allowing most of the foregoing problems to be solved.

Development of these low temperature glasses, however, will impose certain process alterations that may or may not be acceptable.

Patents which are relevant to the present invention are:

Wilson U.S. Pat. No. 4,906,957 which discloses an electrical circuit interconnect system that employs an electrically conductive enclosure and cover which completely encompasses, hermetically seals, and electrically isolates from the outside environment a component mounted on a first surface of an insulating substrate of a microwave circuit. A plurality of conductors mounted on the first surface of the insulating substrate electrically connect the component to the outside electrical circuitry by passing through a corresponding plurality of pass-through bores within the base of the enclosure. Specifically, within each respective pass-through bore, a corresponding glass encased conductor electrically connects each conductor within the enclosure to a conductor outside of the enclosure.

Carnahan et al. U.S. Pat. No. 4,816,791 disclose a transition between stripline transmission lines that includes a coaxial section placed between pads at the ends of the stripline conductors. The coaxial section is formed by a resilient center conductor surrounded by an incomplete circle of pins connected to the ground planes and forming the outer conductor. The connections to the pads enter the ends of the coaxial section at the azimuth of the gap in the circle pins. Good high frequency performance, despite the discontinuity between the pads and coaxial center conductor, is achieved by increasing the characteristic impedance of the coaxial section and that of the stripline near the transition relative to the characteristic impedance of the stripline remote from the transition.

Owens U.S. Pat. No. 4,799,036 discloses a radio frequency coaxial transmission line vacuum feed-through that is based on the use of a half-wavelength annular dielectric pressure barrier disk, or multiple disks, comprising an effective half wavelength structure to eliminate reflections from the barrier surfaces. Gas-tight seals are formed about the outer and inner diameter surfaces of the barrier disk using a sealing technique which generates radial forces sufficient to form seals by forcing the conductor walls against the surfaces of the barrier disks in a manner which does not deform the radii of the inner and outer conductors, thereby preventing enhancement of the electric field at the barrier faces which limits voltage and power handling capabilities of a feed-through.

Bennett U.S. Pat. No. 4,642,578 discloses a radio frequency circuit for ICRF heating that includes a resonant push-pull circuit, a double ridged rectangular waveguide, and a coupling transition which joins the waveguide to the resonant circuit. The coupling transition includes two relatively flat rectangular conductors extending perpendicular to the longitudinal axes of a respective cylindrical conductor to which each flat conductor is attached intermediate the ends thereof. Conductive side covers and end covers are also provided for forming pockets in the waveguide into which the flat conductors extend when the waveguide is attached to a shielding enclosure surrounding the resonant circuit.

Baird et al. U.S. Pat. No. 4,487,999 disclose an all-metal microwave chip carrier with subminiature ceramic feed-throughs, each configured to function as a coaxial cable having a predetermined impedance. In one embodiment, the feed-throughs are formed by providing ceramic tubing metallized inside and out in which the ends are cut away to provide half-cylindrical bonding pads. In order to permit bonding directly to the feed-through, a flat wire lead is soldered to the channel in the ceramic tube, with the ends of the flat wire extending onto the flat portions of the half-cylindrical portions of the feed-through. In one embodiment, the chip carrier includes a base, ring and stepped lid, all made of Kovar or other suitable material, with the lid being weldable to the ring rather than being brazed or soldered.

Schafer et al. U.S. Pat. No. 4,486,726 disclose one end of a coaxial cable that is telescoped into one end of a microwave component such as an attenuator with the outer jacket of the cable being metallurgically bonded by solder to the metal housing of the component.

DISCLOSURE OF THE INVENTION

In accordance With this invention, a hermetically sealed transition joint for use with a microwave package which has a receptacle including a side wall made of a first weldable material with a feed-through opening therein. The transition joint includes a first layer of a first material sized to extend across the feed-through opening and weldable to the side wall to form a hermetic seal. A second layer of a second material is explosively bonded to the first layer and sized to match and be received within the feed-through opening. A connector opening extends through the first and second layers. A pin connector unit made of the second material and having electrical pins extending therethrough is sized to fit within the connector opening and is welded to the second layer to form a hermetic seal. The first layer may be aluminum or aluminum alloy and the second layer can be any one of Kovar, cold rolled steel, stainless steel or iron-nickel alloy. Conveniently, the welding is done by laser welding.

More specifically, the feed-through opening has an enlarged counterbore adjacent the outer side and a smaller bore adjacent to the inner side. The second layer has an outer perimeter which exactly matches the inner perimeter of the smaller bore and the first layer has an outer perimeter which exactly matches the inner perimeter of the counterbore.

The apparatus just described can be manufactured by first forming a feed-through opening in the side wall of the receptacle. Next, a layer of the first material is explosively bonded to a layer of the second material to form a transition joint. Next, a passageway is formed through the transition joint which is configured to the shape and size of the pin connector unit. The transition joint is machined to a configuration corresponding to the shape and size of the feed-through opening. A counterbore can be formed in the feed-through opening at a depth equal to the thickness of the first layer and the machining of the transition joint can be done so that the first layer is of a configuration corresponding in size and shape to the counterbore and the second layer is of a configuration corresponding in size and shape to the remainder of the feed-through opening. The pin connector unit is then positioned in the passageway and welded about its perimeter to the second layer to form a hermetic seal. Next the transition joint is positioned in the feed-through opening and the first layer is welded about its periphery to the side wall to form a second hermetic seal.

Additional advantages of this invention will become apparent from the description which follows, taken in conjunction with the accompanying drawings.

BEST MODE FOR CARRYING OUT THE INVENTION

Figure 1:
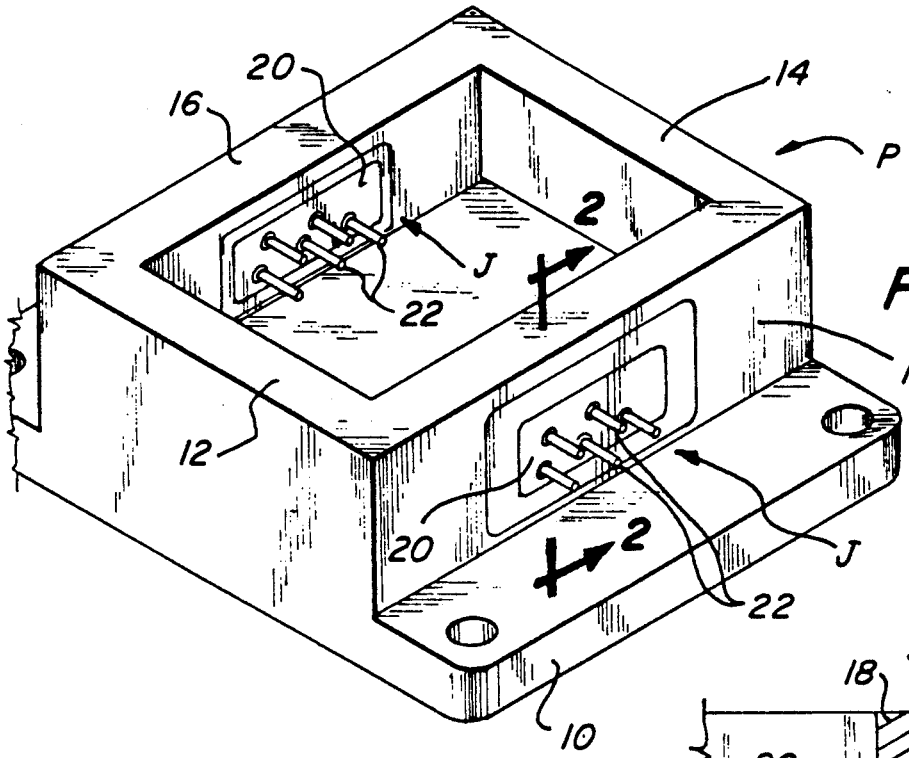
FIG. 1 is a perspective view of a microwave package having a transition joint constructed in accordance with this invention.

In accordance with this invention, a microwave package P is provided which includes a base 10 a first pair of opposed side walls 12 and 14, respectively, and a second pair of opposed side walls 16 and 18, respectively. As illustrated in FIG. 1, both side walls 16 and 18 are provided with a transition joint J having a pin connection unit 20 positioned therein with electrical contact pins 22 extending therethrough. The microwave package is made out of aluminum or aluminum alloy, such as aluminum 4047 which typically contains more than 3% silicon and usually about 12% silicon. The pin connector unit 20 is made of Kovar or some other material such as cold rolled steel, stainless steel or an iron-nickel alloy.

The transition joint comprises a first layer 24 explosively bonded to a second layer 26. The first layer 24 will be the same aluminum or aluminum alloy as microwave package P and the second layer 26 will be made of the same material as pin connection unit 20. These bonded layers form transition joint J.

Figure 2:
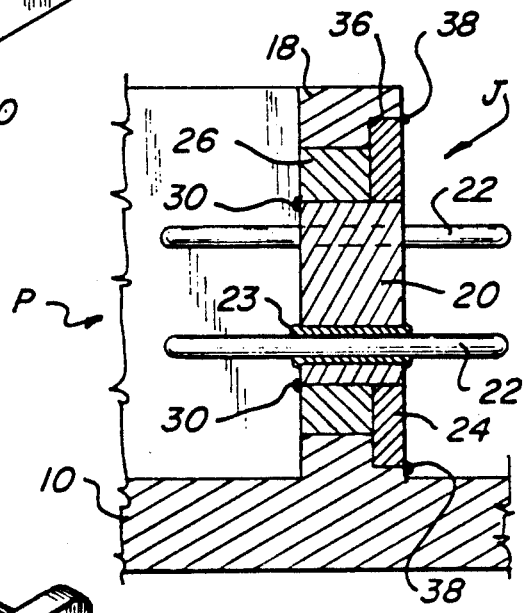
FIG. 2 is an enlarged, fragmentary, vertical section, taken along line 2—2 of FIG. 1, showing further details of the transition joint.

A passageway 28 is cut through the transition joint and has a size and shape corresponding to that of the outer periphery of pin connection unit 20 for receiving the same therein, as best illustrated in FIG. 2. Conveniently, the total thickness of layers 24 and 26 is equal to the thickness of pin connection unit 20 so that the facing surfaces of the pin connection unit and the transition joint are flush. After the pin connection unit is inserted into passageway 28, it is welded to second layer 26 by means of a weldment 30 which extends around the peripheral edge of pin connection unit 20 and forms a hermetic seal at this interface.

Figure 3:
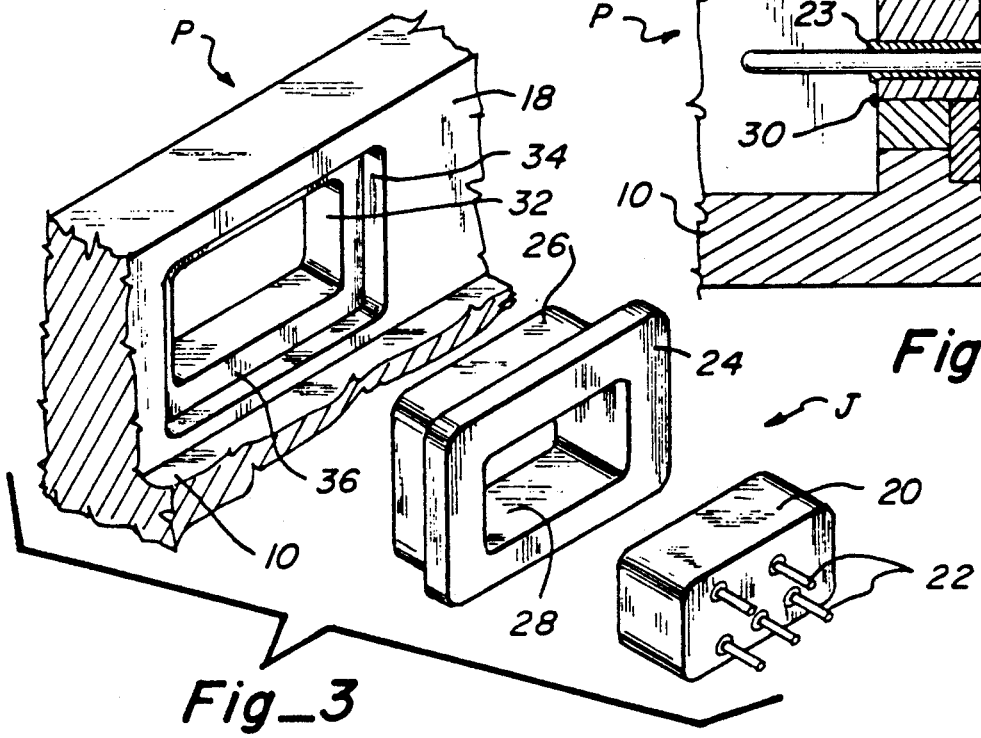
FIG. 3 is a fragmentary exploded view of the transition joint.

A feed-through opening 32 is provided in a side wall, such as side wall 18, shown in FIG. 3, and has a counterbore 34 therein providing an abutment face 36. Conveniently, the counterbore has the same depth as first layer 24 of transition joint J. The first layer of the transition joint is machined so that its outer peripheral edge has a configuration corresponding to the shape and size of the counterbore 34. Similarly, second layer 26 is machined so that its outer peripheral edge has a configuration of a shape and size to be received within pass-through opening 32. Thus, when transition joint J is inserted in the opening in side wall 18, the collar formed by first layer 24 abuts against abutment face 36 and because the depth of counterbore 34 is equal to the thickness of layer 24 the surface of layer 24 is flush with the outer surface of wall 18 and the inner surface of second layer 26 is flush with the inner surface of wall 18. The first layer 36 is then attached to wall 18 by welding to provide a weldment 38 around the peripheral edge of first layer 24 to provide a second hermetic seal.

Conveniently, the weldments 30 and 38 can be accomplished by means of a laser weld or an electron beam welding technique. Such welds are very reliable resulting in a good hermetic seal.

From the foregoing, the advantages of this invention are readily apparent. This method results in fabrication of a package where the feed-throughs of power connectors have been installed without requiring any electroplating and/or soldering. All the joints are laser sealed which is an accepted reliable method of attachment. Any stresses that develop during the thermal cycling remain concentrated on the explosively created bond. Explosive bonding assures shear strength of the joint greater than the weakest of the parent metal in the transition system. Even in unusual cases the strength of the joint is three to four times greater than that of solders. This assures the resiliency of the joint and package reliability is enhanced. This invention allows production of reliable hermetic microwave packages. It allows use of resilient clad materials with bond characteristics far stronger than current method of electroplating and soldering. It also ensures compliance to military specifications after strenuous testing.

This invention has been described in detail with reference to a particular embodiment thereof, but it will be understood that various other modifications can be effected within the spirit and scope of this invention.

we claim:

1. A hermetically sealed transition joint for use with a microwave package having a receptacle which includes a side wall made of a first weldable material with a feed-through opening therein, said transition joint comprising:

a first layer of said first material sized to extend across the feed-through opening and weldable to the side wall to form a hermetic seal;

a second layer of a second material different from said first material explosively bonded to said first layer and sized to match and be received within the feed-through opening;

means defining a connector opening extending through said first and second layers; and a pin connector unit made of said second material and having electrical pin connections extending therethrough and sized to fit within said connector opening and being welded to said second layer to form a hermetic seal.

2. A transition joint, as claimed in claim 1, wherein:

said first layer is aluminum or aluminum alloy; and said second layer is Kovar.

3. A transition joint, as claimed in claim 1, wherein:

said welding is done by laser welding.

4. A transition joint, as claimed in claim 1, wherein the side wall has an outer side and an inner side and the feed-through opening has an enlarged counterbore adjacent the outer side and a smaller bore adjacent the inner side, and wherein:

said second layer has an outer perimeter which exactly matches the inner perimeter of the smaller bore; and said first layer has an outer perimeter which exactly matches the inner perimeter of said counterbore.

5. In a microwave package having a receptacle made of a first material and having a side wall with a feed-through opening therein, the improvement comprising:

a hermetically sealed transition joint have a first outer layer made of said first material and a second inner layer explosively bonded to said first layer and made of a second material different from said first material, said transition joint being configured to have a peripheral edge to match the shape of said feed-through opening and positioned therein in mating relationship;

a first weldment extending around said peripheral edge of said joint joining said first layer to said side wall in a hermetically sealed relationship;

a central passageway through said first and second layers;

a pin connector unit having a body made of said second material and being configured to have a peripheral edge to match the shape of said passageway and received therein in mating relationship, electrical pin connectors extending through said unit; and a second weldment extending around said peripheral edge of said unit joining said unit to said second layer in a hermetically sealed relationship.

6. A microwave package, as claimed in claim 5, wherein:

said feed-through opening has a counterbore in the outer portion thereof having a depth equal to the thickness of said first layer and forming an abutment surface;

said first layer being configured to have a peripheral edge to match the shape of said counterbore and to bear against said abutment surface; and said second layer being configured to have a peripheral edge to match said feed-through opening.

7. A microwave package, as claimed in claim 6, wherein:

the combined thickness of said first and second layers is the same as the thickness of said side wall.

8. A microwave package, as claimed in claim 5, wherein:

said microwave package and said first layer are aluminum or an aluminum alloy; and said second layer and said pin connector unit are made of any one of Kovar, cold rolled steel, stainless steel or iron-nickel alloy.

9. A microwave package, as claimed in claim 5, wherein:

said microwave package and said first layer have one coefficient of thermal expansion; and said second layer and said pin connector unit have a second and different coefficient of thermal expansion.

* * * * *